US005337841A

United States Patent [19]

Mukai

[11] Patent Number: 5,337,841

[45] Date of Patent: Aug. 16, 1994

[54] HAMMER TYPE SOIL EXCAVATING MACHINE

[76] Inventor: Toshio Mukai, 2-20-94 Azukimoti, Hamamatsu, 433, Japan

[21] Appl. No.: 27,523

[22] Filed: Mar. 8, 1993

[30] Foreign Application Priority Data

Mar. 10, 1992 [JP] Japan ..... 4-101539
Mar. 5, 1993 [JP] Japan ..... 5-045412

[51] Int. Cl.[5] ..... E21B 1/00

[52] U.S. Cl. ..... 175/293; 37/904; 173/97

[58] Field of Search ..... 37/904; 175/293, 415; 173/97, 105, 117

[56] References Cited

U.S. PATENT DOCUMENTS 2,403,041 7/1946 Beyerink ..... 173/97 X

*Primary Examiner*—William P. Neuder
*Attorney, Agent, or Firm*—Kanesaka & Takeuchi

[57] ABSTRACT

A hammer device is coupled to an outer portion of a handle, an operating portion is attached to the other portion of the handle, a holding section is attached to one side of the operating portion, and at the same time, a pair of excavators is rotatably attached to an outer portion of the holding section to conduct a bumping operation and opening and closing operations upon transmission from the operating portion. By this, burdens imposed on workers are reduced, at the same time, security of work is assured and time required for completion of works can be greatly shortened and reduced.

8 Claims, 8 Drawing Sheets

HAMMER TYPE SOIL EXCAVATING MACHINE

BACKGROUND OF THE INVENTION

1. Field of the Invention

The present invention relates to a hammer type soil excavating machine which is used in a civil engineering and construction industry, and which can excavate a vertical hole, a horizontal hole or a diagonal hole easily, accurately and quickly.

2. Description of the Prior Art

Heretofore, as a tool for excavating a vertical hole or horizontal hole in the ground, there have been known, for example, a sword-type scoop or a semi circle-type scoop to which a handle is attached, and a device comprising two scoops facing each other wherein base portions of the two scoops are hinged, and handles are attached thereto.

And, as these scoops are operated by man power to excavate soil and sand, for example, when a deep hole is dug by the former, the surrounding of the hole is also dug so that the hole becomes a conical shape and unnecessary digging operation is involved.

Also, in the latter case, since the combination of the two scoops is operated by a lever attached to the handles to open and close, it is difficult to dig a hole of a depth of about one meter.

Further, in the hard ground, since it is impossible for the scoop to penetrate into the ground by man power, it has been dealt with a method such that stones and sand are broken down by a long iron bar and then taken out.

Furthermore, a vertical hole can be dug by the tools as mentioned above to a certain extent, but work is very difficult when a horizontal hole or a diagonal hole is dug at a narrow spot.

Also, a long digging time is required as well as a working posture of an operator is unstable, which imposes a burden on the operator and results in poor working efficiency.

Especially, lately, sewerage works often take place, and digging of a horizontal hole at a place where a machine drilling in a large scale cannot be conducted under the field condition becomes a factor of delaying the whole construction work, because such work relies on aged workers due to decrease of young workers who are engaged in the construction work, and the working efficiency is decreased therefor.

SUMMARY OF THE INVENTION

The present invention is to solve the above-described problems, and to provide a hammer type soil excavating machine, wherein hammer means is coupled to an outer portion of a handle, an operating portion is attached to the other portion of the handle, a holding section is attached to one side of the operating portion, and at the same time, at an outer portion of the holding section, a pair of excavators which provide hammer operation and opening and closing operations upon transmission from the operating portion is rotatably attached so that a vertical hole, a horizontal hole or a diagonal hole can be easily, accurately and quickly excavated.

And, when an excavation is carried out, as hammer power is imparted by a machine, burdens imposed on workers are greatly reduced when compared with the prior manual excavation, and digging hole can be performed safely, smoothly and simply.

Also, since the excavators can be closed or opened at will by rotating operation of the handle while excavating, excavated sand can be positively held and easily taken out from the hole.

Further, since the excavating device has a simple construction and light weight, it can be easily carried and even in a narrow spot, a hole can be excavated uniformly.

Further, since working efficiency is greatly improved, a specific effect such that the prevailing cost of construction is lowered can be obtained.

DESCRIPTION OF THE PREFERRED EMBODIMENTS

Next, an embodiment of a hammer type soil excavating machine relating to the present invention is described based on drawings.

Figure 1:
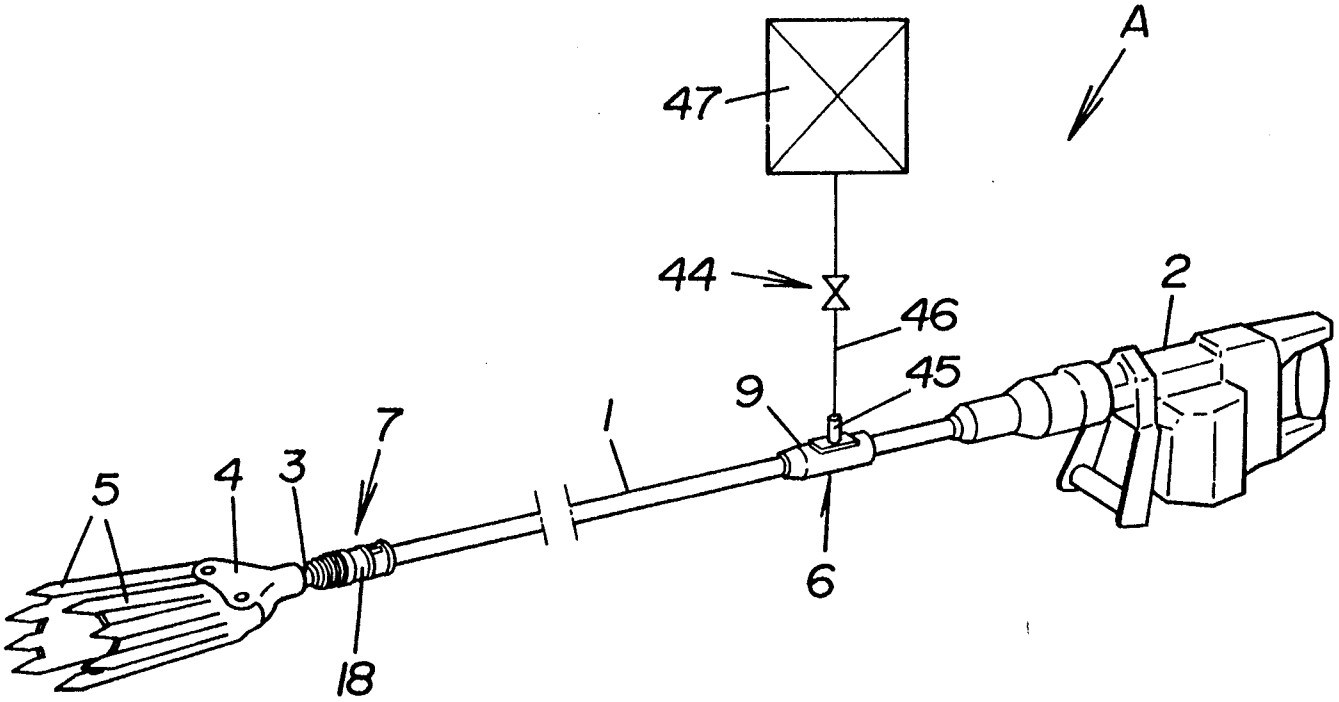
FIG. 1 is a partially omitted perspective view showing one embodiment of a hammer type soil excavating machine according to the present invention.

In FIG. 1, A represents a soil excavating machine which is used to excavate a vertical hole, a horizontal hole or a diagonal hole with a relatively small 1 diameter, such as, digging holes for piping works accompanying water and sewerage, gas pipe construction and pillar construction for temporary electric distribution, digging holes for signboard legs, foundation digging for buildings, digging holes for plants, and digging holes for supporting poles for a fence.

And, a construction thereof basically comprises a handle 1, hammer device 2, an operating portion 3, a holding section 4, and a pair of excavators 5, 5.

The handle 1 mentioned before is made of solid metal with a hollow shape and is formed with every predetermined length such as, for example, 300 mm and 450 mm, in a range of 300 mm to 3,000 mm, among which a handle with a suitable length is selected according to a construction condition.

Figure 5:
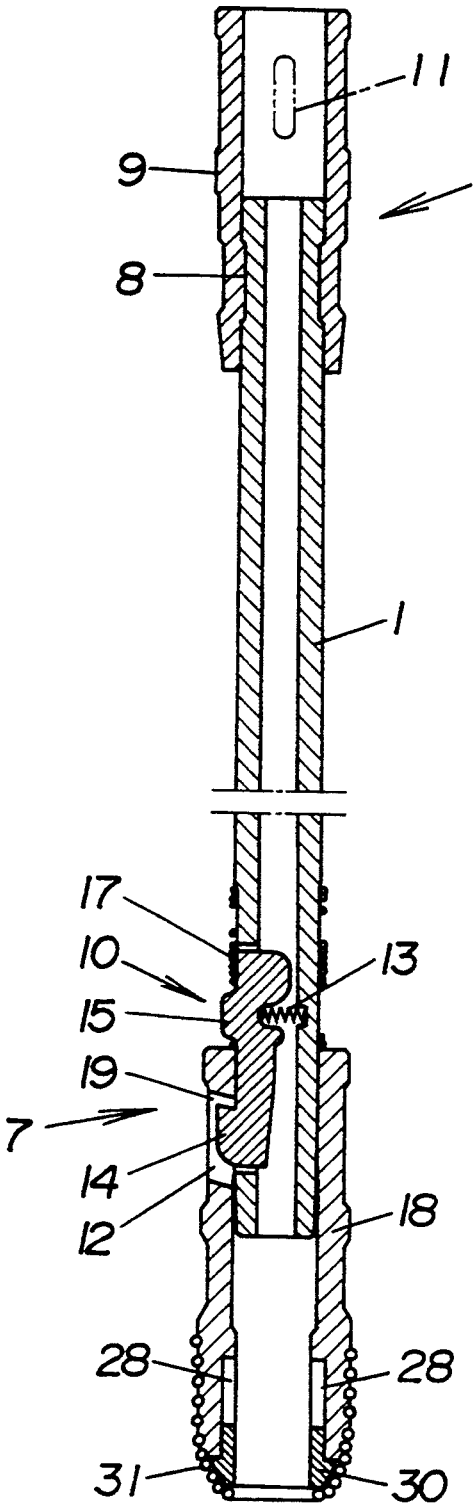
FIG. 5 is a section view in a state where a connection member is attached to the handle of FIG. 4.
Figure 6:
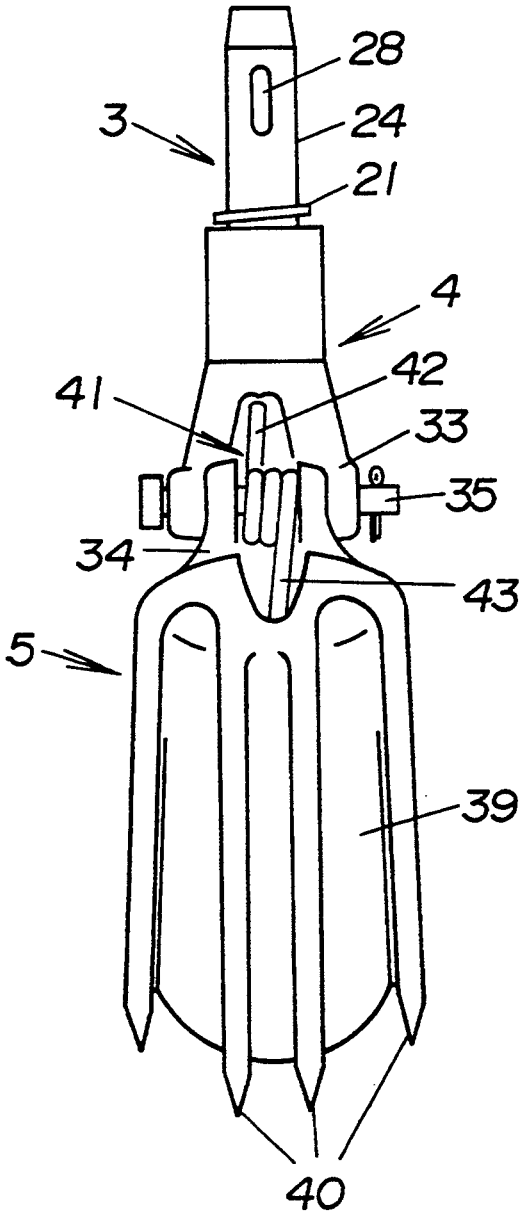
FIG. 6 is a side view of an essential part of FIG. 2.
Figure 7:
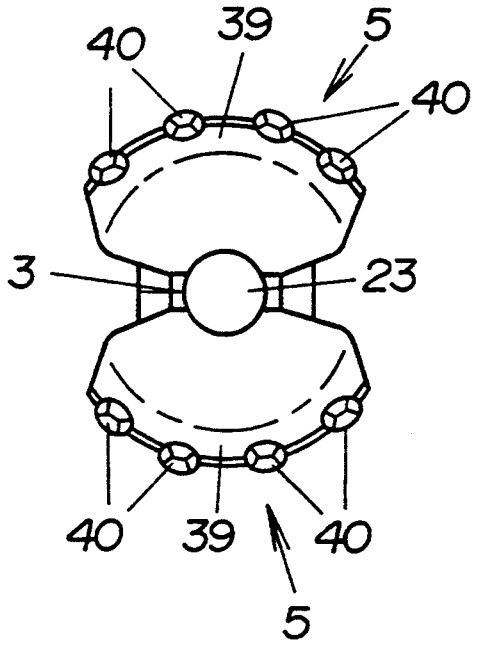
FIG. 7 is a bottom view of FIG. 6.

And, as shown in FIGS. 1 and 5, connecting devices 6 and 7 are provided at both ends of the handle for extension when excavation progresses, and the connecting device 6 is provided at an outer end portion of the handle 1, that is, on the side where the hammer device 2 is attached.

Figure 4:
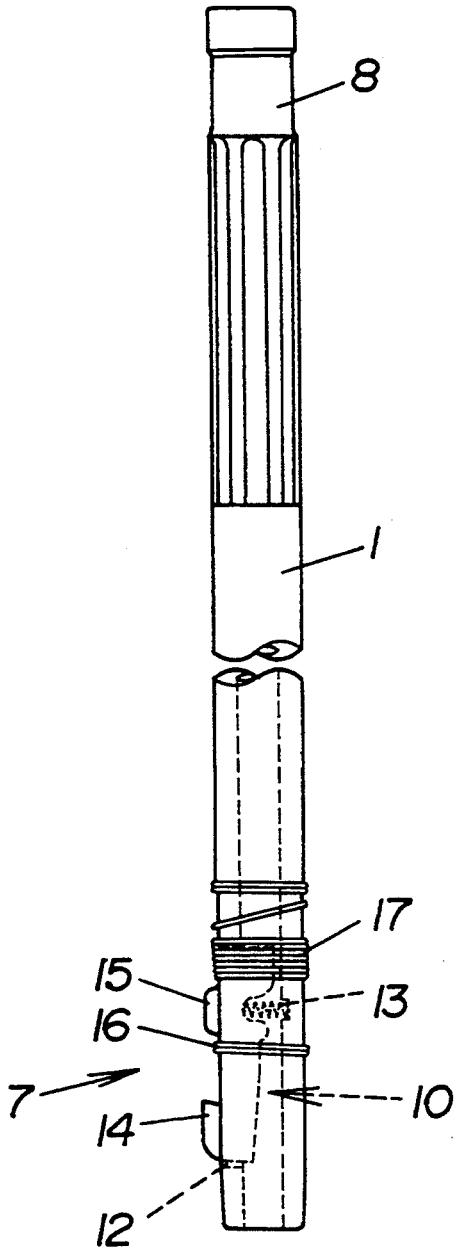
FIG. 4 is a front view of a handle of FIG. 1.

The outer end portion mentioned above, as shown in FIGS. 4 and 5, has a polygonal shape such as a hexagon, and a concave portion 8 is provided around a circumference thereof. After an outer socket 9 such as a coupling having an inner diameter corresponding to the outer shape of the handle 1 is engaged so that an outer side thereof projects from the outer end portion of the handle 1, the outer socket 9 is cramped at the concave portion so that movements in an axial direction and a rotating direction are stopped and fixed thereto.

Further, in a portion projecting from the handle 1 of the outer socket 9, a receiving hole 11 in which an engaging member 10 of the connecting device 7 mentioned later is fitted is provided at a circumferential side to extend in an axial direction.

Also, the connecting device 7 mentioned above is provided at an inner end portion of the handle 1, and the engaging member 10 is received in a slit 12 provided to extend in an axial direction at the inner end portion thereof so that the engaging member 10 is always urged to project outwardly from an outer circumference of the handle body 1 by a spring 13.

The engaging member 10 is formed of a plate-shape metal, and is provided, at an extreme end thereof, with a hook portion 14 for engaging with a receiving hole 19 of an inner socket 18 such as a device 20 mentioned later, and at an intermediate portion thereof, with a pressing portion 15 for conducting engagement and unlocking of the engaging member 10 and the receiving hole 11.

And, by coil-shape springs 16 and 17 mounted on this inner end portion, the engaging member 10 is prevented from being projected outwardly by the spring 13 and is held in a constant position.

Incidentally, the connecting device 7 is to be connected to the inner socket 18, and by engaging the hook portion 14 of the engaging member 10 with the receiving hole 19 provided at the outer circumference of the inner socket 18, an operating portion 3 described later is coupled.

The handle 1, when excavation progresses, can be extended to a desired length by gradually connecting the handles by the connecting devices 6 and 7 mentioned before.

The hammer device 2 mentioned before is to generate a hitting force with a predetermined amount and interval and an ordinary electric hammer or air/oil pressure hammer is used, an attaching portion of the hammer device 2 being mounted to the connecting device 6 of the handle body 1.

The operating portion 3 mentioned before is to transmit the hitting force transmitted from the hammer device 2 through the handle 1 to the excavators 5, 5.

The operating portion 3 is treated to have a predetermined strength in its entirety and is formed in a rod shape, and the operating portion 3 is to be attached to the inner end portion of the handle 1 through the coupling device 20 and is composed of the coupling device 20, and a fitting shaft 24 having an external thread 21, a bumping member 22 and a blockade member 23.

And, the coupling device 20 mentioned before is connected to the handle 1, and the fitting shaft 24 is inserted into an attaching hole 25 provided at a side of the coupling device 20 or the inner socket 18.

Further, the connecting device 7 of the handle 1 is connected to a coupling hole 26 provided on the other side of the inner socket 18.

Also, in the inner socket 18, the hitting force from the handle 1 is transmitted to the fitting shaft 24 through an intermediate cylinder 27, and end surfaces of the handle 1 and the fitting shaft 24 can be protected from damages caused by bumps.

Furthermore, the fitting shaft 24 and the inner socket 18 are formed such that rotation is transmitted by sliding keys 29 provided in grooves of the fitting shaft 24 and long grooves 28 of the inner socket 18. A collar 30 is mounted on the inner socket 18 and is supported by an outer spring 31 attached to the inner socket 18.

Accordingly, the hammer force actuates the sliding key 29 to slide in the long groove 28 and to hit to the collar 30, and the hitting force from the handle 1 is absorbed by the outer spring 31 mounted on the handle 1 so that damages of the sliding key 28 can be prevented.

The external thread 21 mentioned before is screwed into a connecting member 32, such as an internal thread of the holding section 4 to rotatably connect the operating section 3 and the holding section 4.

The bumping member 22 mentioned before is provided at an outer side of the external thread 21 in a shape of collar to transmit the hitting power to the pair of the excavators 5, 5.

The blockade member 23 mentioned before is provided at an outer end of the operating portion 3 in a shape of collar so as to impart blockading power to the pair of the excavators 5, 5.

Figure 3:
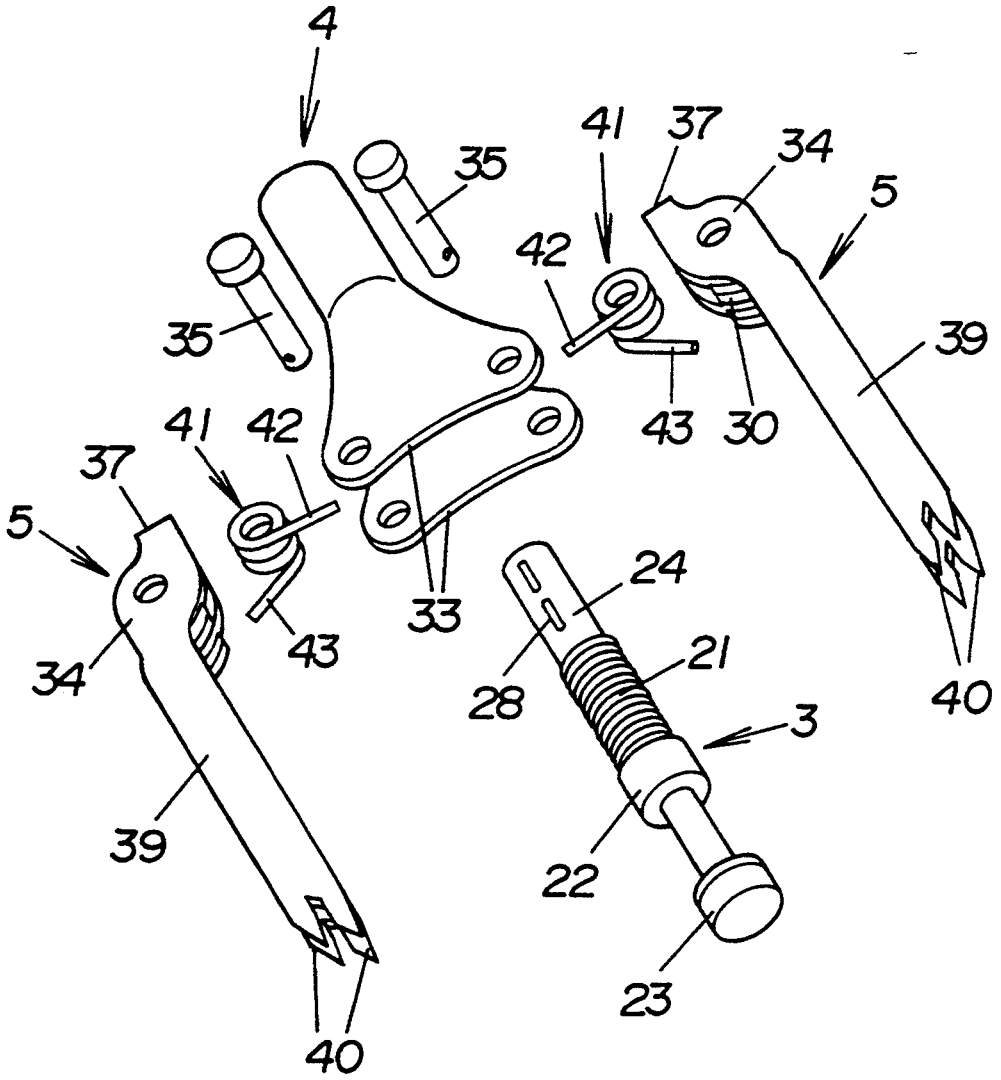
FIG. 3 is an exploded perspective view of FIG. 2.

The holding section 4 mentioned before is attached to the external thread 21 of the operating portion 3 to support the pair of the excavators 5, 5. As shown in FIG. 3, the holding section 4 is formed in a shape of bifurcated chevron, a connecting member 32 such as an internal thread is provided in a cylindrical portion at the top portion thereof, and attaching portions 33 for the pair of the excavators 5, 5 are provided at both skirt portions thereof.

Incidentally, the external thread 21 and the internal thread 32 are formed in square shapes and engagement thereof is made with a little clearance (about 3 mm) so that when the operating portion 3 is hit, impact is not imparted to the internal thread 32.

The pair of the excavators 5, 5 mentioned before is rotatably mounted at the outer portions of the holding section 4, and performs a hitting operation and opening and closing operations transmitted from the operating portion 3.

And, base portions 34, 34 are rotatably attached to the attaching portions 33 of the holder 4 by means of pivotal shafts 35, 35, and from the base portions 34, 34 toward an interior thereof, projecting pieces 36, 36 are correspondingly extended.

Figure 2:
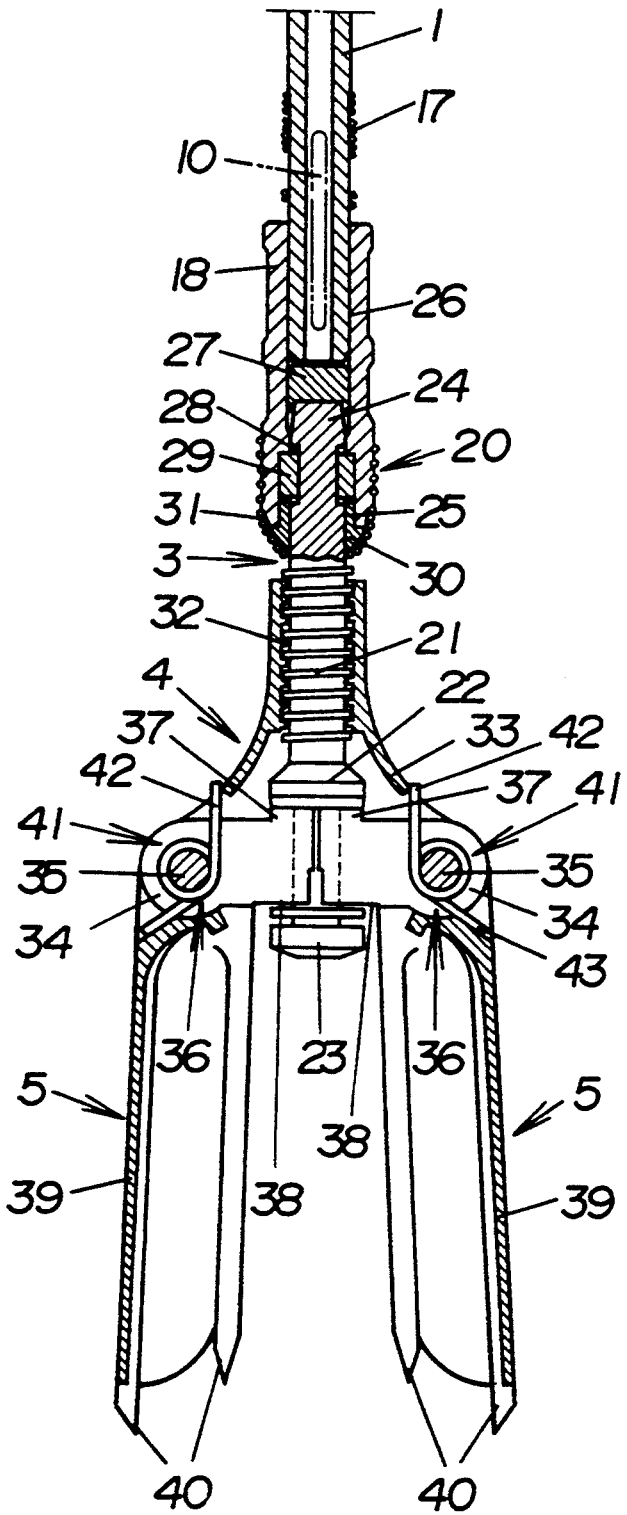
FIG. 2 is an enlarged vertical front view of an essential part of FIG. 1.

The projecting pieces 36, 36, as shown in FIGS. 2 and 3, are formed in a bifurcated shape, receiving members 37, 37 against which a lower surface of the bumping member 22 of the operating portion 3 abuts are provided at the upper end portions thereof, and further, engaging members 38, 38 against which an upper surface of the blockade member 22 of the operating portion 3 abuts are integrally formed at the lower end portion thereof.

Further, excavated soil holding members 39, 39 with arc surfaces are extended from the base portions 34, 34 in the direction of right angles with respect to the projecting pieces 36, 36, and breaking members 40, 40 in sword shapes are provided at plural portions of the forward ends of the holding members thereby to break down obstacles such as rocks and stones in the earth to a suitable size to be held.

Also, in the excavators 5, 5, closing springs 41, 41 in the coil shapes are attached to the pivotal shafts 35, 35, and one of respective leg portions 42, 42 thereof is engaged with the holding section 4 and the other of the respective leg portions 43, 43 is engaged with the excavators 5, 5 so that the holding members 39, 39 of the excavators 5, 5 are always urged to direct toward inner directions, i.e., closing direction.

By this, when the handle body 1 is rotated in one direction while the holding members 39 are fixed, the external thread 21 of the operating portion 3 screwed into the internal thread 32 of the holding section 4 advances, the bumping member 22 pushes the receiving members 37 of the excavators 5, and the holding members 39 open outwardly around the pivotal shafts 35.

Also, when the handle 1 is rotated to the other direction, i.e., opposite direction, the external thread 21 of the operating portion 3 screwed into the internal thread 32 of the holding section 4 retracts, the bumping member 22 abutting against the receiving members 37 separates therefrom, at the same time, the blockade member 23 presses the engaging members 38 of the excavators 5, and the holding members 39 are closed inwardly around the pivotal shafts 35 in cooperation with the closing springs 41.

In FIG. 1, numeral 44 is a cooling device for bumping portions, and by supplying water to the inner end portion of the handle 1, the intermediate cylinder 27 and an outer end portion of the fitting shaft 24 of the operating portion 3 which are bumping portions, heat generated by hitting while using the device is suppressed, and durable life of the portions and workability of a worker can be improved.

And, the construction thereof is such that an attaching member 45 is fixed to the outer socket 9 at the base portion of the handle 1, and a water supply member 47 communicating with the bumping portions through the hollow portion of the handle 1 is coupled to a water supply pipe 46 of the attaching member 45.

As described above, when the breaking members 40, 40 in an open state of the excavators 5, 5 are applied to the ground and the operating portion 3 is bumped by the hammer device 2 through the handle 1, the bumping power is transmitted to the excavators 5, 5 and the excavators enter into the ground in the open state.

When entered at a predetermined length, as the handle 1 is rotated, the operating portion 3 is retracted by movement of the threads, and the excavators 5, 5 are closed to hold the soil therein.

At this time, since the blockade member 23 of the operating portion 3 operates the engaging members 38, 38 of the excavators 5, 5 so that the excavators 5, 5 are moved inwardly, and the excavated soil is firmly held therein.

Opening of the excavators 5, 5 is conducted such that when the operating portion 3 is advanced by movement of the threads due to rotation of the handle 1 while the excavators 5 are immovably held on the ground in the same manner as mentioned before, the receiving members 37, 37 of the excavators 5, 5 are pressed to rotate outwardly and to open for discharging the soil.

According to the device of the present embodiment, an excavating work of a hole for attaching a pipe at sewerage works, the hole having a diameter of 17 phi (cm) and a depth of 1.3 m at a place of 25–30N value, took 35 minutes to complete it, while the prior manual excavating work took about 2 hours.

Also, for the ground of an upper conglomerate layer of 50 cm and a lower hard clayey layer of 70 cm, excavating works of a hole with a diameter size of 17 phi (cm) for a temporary electric light pole took 40 minutes by means of the conventional manual digging, while the device of the embodiment according to the present invention completed the excavating works in 16 minutes.

Moreover, a neat hole with a cylindrical shape from the upper portion to the lower portion could be excavated.

Figure 8:
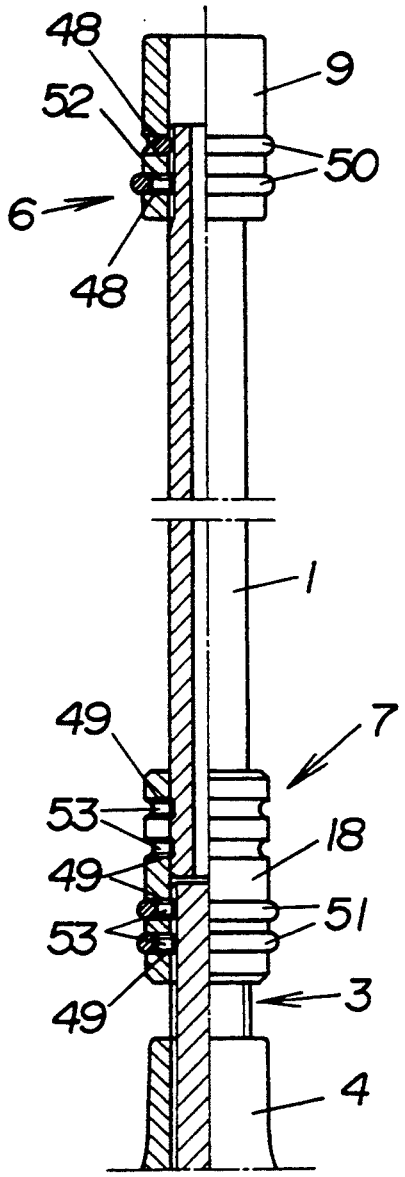
FIG. 8 is a half section view showing another embodiment of the handle of FIG. 1.

FIG. 8 shows another embodiment of the handle 1, wherein the basic structure is the same as that of the handle 1 mentioned before, but the structures of connecting devices 6 and 7 are different.

More specifically, connections of the handle 1 with the outer socket 9 and with the inner socket 18 are performed by fixing with external threads and internal threads provided at the respective sockets, attaching spring rings 50, 51 to grooves 48, 49 formed on outer peripheral portions of the outer socket 9 and the inner socket 18, and engaging parts of the spring rings with crests of the external threads of the handle 1.

Further, by abutting set screws 52, 53 screwed in the external socket 9 and the internal socket 18 against the crests of the external threads of the handle 1, fixing can be improved further.

What is claimed is:

1. A hammer type soil excavating machine comprising: a handle portion having outer and inner portions, hammer means connected to the outer portion of said handle portion to provide a hammer operation with bumping power toward the inner portion of the handle portion, and operating portion attached to the inner portion of said handle portion, a holding section attached to and actuated by the operating portion, and a pair of excavators pivotally attached to said holding section, said excavators receiving the bumping power from the hammer means through the handle portion and the operating portion and opening and closing operations from the handle portion through said operating portion so that soil is cut and removed by the excavators to form a hole easily.

2. The hammer type soil excavating machine according to claim 1, wherein said handle portion is provided with connecting means at both ends thereof for extension thereof.

3. The hammer type soil excavating machine according to claim 1, further comprising cooling means attached to the operating portion.

4. The hammer type soil excavating machine according to claim 1, wherein said excavators are arranged to face against each other and to tilt relative to the holding section so that soil is held between the excavators when tilted.

5. A hammer type soil excavating machine comprising, a handle portion having outer and inner portions, hammer means connected to the outer portion of said handle portion, an operating portion attached to the inner portion of said handle portion, said operating portion including coupling means provided at one side thereof to be connected to the handle portion, an external thread, a bumping member provided at the other side thereof to receive bumping power from said hammer means, and a blockade member projecting from said bumping member;

a holding section attached to the operating portion, said holding section including an internal thread engaging the external thread of the operating portion at one side thereof, and excavator attaching portions provided on the other side thereof; and a pair of excavators rotatably attached to the holding section, each including a base portion rotatably attached to said attaching portion of the holding section by means of a pivotal shaft, a projecting piece extending inwardly from said base portion and having a receiving member abutting against said bumping member of the operating portion on one end and an engaging member abutting against the blockade member of the operating portion on the other side thereof, an excavated soil holding member extending from said base portion in a direction normal to the projecting piece and provided with breaking members at a forward end thereof, and a closing spring provided at said pivotal shaft to urge the holding member to direct inwardly, said excavators receiving the hammer operation and opening and closing operations through said operating portion and said handle portion so that soil is removed to form a hole easily.

6. The hammer type soil excavating machine according to claim 5 wherein said coupling means of the operating portion comprises a fitting shaft having said external thread, said bumping member and said blockade member, and a joint having an attaching hole provided at one end thereof for retaining the fitting shaft therein and a coupling hole provided on the other end thereof for connecting the joint to the handle portion.

7. The hammer type soil excavating machine according to claim 5, wherein said handle portion is provided with connecting means at both ends thereof for extension thereof.

8. The hammer type soil excavating machine according to claim 5 further comprising cooling means attached to the operating portion.

* * * * *

UNITED STATES PATENT AND TRADEMARK OFFICE

CERTIFICATE OF CORRECTION

PATENT NO. : 5,337,841

DATED : August 16, 1994

INVENTOR(S) : Toshio Mukai

It is certified that error appears in the above-identified patent and that said Letters Patent is hereby corrected as shown below:

On title page, item [76] inventor's address,
change "2-20-94" to --2-20-24--.

Signed and Sealed this

Twenty-seventh Day of September, 1994

*Attest:*

Bruce Lehman

BRUCE LEHMAN

*Attesting Officer*

*Commissioner of Patents and Trademarks*